US008560312B2

(12) United States Patent
Etter

(10) Patent No.: US 8,560,312 B2
(45) Date of Patent: Oct. 15, 2013

(54) METHOD AND APPARATUS FOR THE DETECTION OF IMPULSIVE NOISE IN TRANSMITTED SPEECH SIGNALS FOR USE IN SPEECH QUALITY ASSESSMENT

(75) Inventor: Walter Etter, Wayside, NJ (US)

(73) Assignee: Alcatel Lucent, Paris (FR)

( * ) Notice: Subject to any disclaimer, the term of this patent is extended or adjusted under 35 U.S.C. 154(b) by 927 days.

(21) Appl. No.: 12/640,744

(22) Filed: Dec. 17, 2009

(65) Prior Publication Data

US 2011/0153313 A1 Jun. 23, 2011

(51) Int. Cl.
*G10L 21/02* (2013.01)

(52) U.S. Cl.
USPC ..... 704/233; 704/226

(58) Field of Classification Search
USPC ..... 704/226, 233
See application file for complete search history.

(56) References Cited

U.S. PATENT DOCUMENTS

| | | | | |
|---|---|---|---|---|
| 8,145,205 | B2 * | 3/2012 | Vaisanen et al. | 455/423 |
| 2003/0043925 | A1 * | 3/2003 | Stopler et al. | 375/254 |
| 2004/0170164 | A1 * | 9/2004 | LeBlanc et al. | 370/389 |
| 2005/0143974 | A1 * | 6/2005 | Joly | 704/201 |
| 2007/0011006 | A1 * | 1/2007 | Kim | 704/233 |

OTHER PUBLICATIONS

"Perceptual evaluation of speech quality (PESQ): An objective method for end-to-end speech quality assessment of narrow-band telephone networks and speech codecs," ITU-T Recommendation P.862, Feb. 2001, 27 pages.

"Single-ended method for objective speech quality assessment in narrow-band telephony applications," ITU-T Recommendation P.563, May 2004, Part 1 of 2, 35 pages.

"Single-ended method for objective speech quality assessment in narrow-band telephony applications," ITU-T Recommendation P.563, May 2004, Part 2 of 2, 28 pages.

M. Bertocco et al, "Nonintrusive Measurement of Impulsive Noise in Telephone-Type Networks", IEEE Transactions on Instrumentation and Measurement, vol. 47, No. 4, Aug. 1998, pp. 864-868.

A.W. Rix, "Perceptual Speech Quality Assessment—A Review," in Proc. IEEE Int. Conf. Acoustics, Speech, and Signal Process., 2004, pp. 1056-1059.

P. Gray et al, "Non-Intrusive speech-quality assessment using vocal-tract models," Proc. IEE Vis. Image Signal Process., vol. 147, No. 6, Dec. 2000, pp. 493-501.

(Continued)

*Primary Examiner* — Abul Azad
(74) *Attorney, Agent, or Firm* — N. DeSaj; K. M. Brown

(57) ABSTRACT

A method and apparatus for performing speech quality assessment in a speech communication system (such as, for example, a VoIP communication system) which detects and measures the presence of impulsive noise is provided. Specifically, in one illustrative embodiment, an autoregressive (AR) model of speech (and, in particular, of the excitation of the vocal tract) is advantageously employed to estimate a short-term variance of the speech excitation, and the standard deviation of the speech excitation (i.e., the square root of the variance) is then advantageously compared to a predetermined threshold to identify whether impulsive noise is present. Then, based on a statistic analysis of any such identified impulsive noise, a speech quality assessment is generated.

24 Claims, 4 Drawing Sheets

(56) References Cited

OTHER PUBLICATIONS

L. Malfait et al, "P.563—The ITU-T Standard for Single-Ended Speech Quality Assessment," IEEE Trans. on Audio, Speech, and Language Process., vol. 14, No. 6, Nov. 2006, pp. 1924-1931.

W. Etter, "Restoration of a Discrete-Time Signal Segment by Interpolation Based on the Left-Sided and Right-Sided Autoregressive Parameters," IEEE Trans. Signal Proc., vol. 44, No. 5, May 1996, pp. 1124-1135.

S.V. Vaseghi et al, "Restoration of Old Recording," J. Audio Eng. Soc., vol. 40, No. 10, Oct. 1992, pp. 791-801.

S.J. Godsill et al, "A Bayesian Approach to the Restoration of Degraded Audio Signals," IEEE Trans. Speech and Audio Process., vol. 3, No. 4, Jul. 1995, pp. 267-278.

W. Etter et al, "Noise Reduction by Noise-Adaptive Spectral Magnitude Expansion," J. Audio Eng. Soc., vol. 42, No. 5, May 1994, pp. 341-349.

* cited by examiner

METHOD AND APPARATUS FOR THE DETECTION OF IMPULSIVE NOISE IN TRANSMITTED SPEECH SIGNALS FOR USE IN SPEECH QUALITY ASSESSMENT

FIELD OF THE INVENTION

The present invention relates generally to the field of speech communications networks such as, for example, Voice Over Internet Protocol (VoIP) speech communications systems, and more particularly to a method and apparatus for the detection of impulsive (i.e., impulse-like) noise in speech signals transmitted across such networks for use in speech quality assessment.

BACKGROUND OF THE INVENTION

In VoIP communication systems, resultant speech quality may be adversely affected by many types of noise. However, most research in this area has been directed at stationary or near-stationary noise, and little attention has been paid to impulsive (i.e., impulse-like) noise. Although current models for measuring speech quality predict degradation due to stationary or near-stationary noise with acceptable accuracy, the accuracy of such models for speech corrupted by impulsive noise has not been addressed. As used herein, impulsive (or impulse-like) noise comprises the noise which results from the corruption of an isolated speech sample or of a small number of successive speech samples within the speech signal.

Speech quality assessment can be divided into two categories:

(1) double-ended (or intrusive) measurements, whereby a reference signal is passed through the transmission channel and the received signal is subsequently compared to the reference signal, and (2) single-ended (or non-intrusive) measurements, whereby only the received signal is accessible and used for assessment of the speech quality.

The most prominent methods for objective speech quality assessment are embodied in certain standards (i.e., "Recommendations") promulgated by the International Telecommunications Union, in particular, ITU-T Recommendation P.862, a double-ended measurement method, and ITU-T Recommendation P.563, its single-ended counterpart, each of which is fully familiar to those of ordinary skill in the art. In addition, at least one method for non-intrusive measurement of impulsive noise in telephone-type networks has previously been proposed, but that particular method assesses the presence of impulsive noise only during speech pauses (i.e., portions which do not include speech), and thus cannot be used during speech activity.

To monitor real-time voice traffic, VoIP service providers typically run a single-ended speech quality assessment technique, such as, for example, ITU-T Recommendation P.563, that provides not only an overall value for predicted speech quality—typically represented by a "Mean Opinion Score" (MOS) value on a scale from 1 to 5 (representing bad to excellent speech quality)—but also detailed statistics of speech quality and accompanying noise. (The use of Mean Opinion Scores is fully familiar to those of ordinary skill in the art.) For example, ITU-T Recommendation P.563 assesses local and global background noise, among others, but it does not measure, nor even detect, the presence of impulsive noise (e.g., the corruption of an isolated speech sample or of a small number of successive speech samples), even though such noise can severely bias speech quality results. In fact, certain experiments have shown that ITU-T Recommendation P.563 often actually gives a higher MOS score (indicating better speech quality) in the presence of impulsive noise, than in its absence—a result which is clearly inconsistent with its underlying purpose. In fact, human listeners will invariably find the presence of such impulsive noise extremely disturbing, despite ITU-T Recommendation P.563's failure to properly measure its presence. Therefore, what is needed is a speech quality assessment technique that detects and measures the presence of impulsive noise during speech activity in a received speech signal, for use in speech quality assessment within a speech communications system.

SUMMARY OF THE INVENTION

In early models for subjective speech quality assessment, speech quality was derived from echo, delay, noise, and loudness. Only later was speech quality assessment improved by the use of vocal tract transition constraints. However, current methods (as represented, for example, by ITU-T Recommendation P.563) make only use of constraints on vocal tract parameters. The instant inventor has recognized that, by exploiting constraints on the excitation of the vocal tract model, a speech quality assessment technique that detects and measures the presence of impulsive noise for use in speech quality assessment within a speech communications system may be advantageously provided.

In particular, therefore, a method and apparatus for performing speech quality assessment in a speech communication system (such as, for example, a VoIP communications system) which detects and measures the presence of impulsive noise during speech activity is provided. Specifically, an impulse noise detector advantageously detects the presence of impulsive noise during active speech portions of a received speech signal, and then, based on such detection of impulsive noise, a speech quality assessment is advantageously performed. (As used herein, the phrases "active speech portions" and "speech activity" are used synonymously to indicate portions of a speech signal during which there is actual speech, rather than portions of a speech signal during which there is silence.)

In accordance with one illustrative embodiment of the present invention, an autoregressive (AR) model of speech (and, in particular, of the excitation of the vocal tract) is advantageously employed to estimate a short-term variance of the speech excitation, and the standard deviation of the speech excitation (i.e., the square root of the variance thereof) is then used to determine a threshold which is advantageously compared to the vocal tract excitation to identify whether impulsive noise is present. Then, based on a statistic analysis of any such identified impulsive noise, the speech quality assessment is generated.

In particular, in accordance with one illustrative embodiment of the present invention, a method for performing speech quality assessment of a speech signal is provided, the speech signal received from a speech communications network, the method comprising receiving a speech signal from the speech communications network; applying an impulse noise detector to the speech signal to detect impulsive noise contained in the speech signal during active speech portions thereof; and performing speech quality assessment of the speech signal based on the detection of impulsive noise in the speech signal during active speech portions thereof by the impulse noise detector.

In accordance with another illustrative embodiment of the present invention, an apparatus for performing speech quality assessment of a speech signal is provided, the speech signal received from a speech communications network, the apparatus comprising: a signal receiver which receives a speech signal from the speech communications network; an impulse noise detector applied to the speech signal to detect impulsive noise contained in the speech signal during active speech portions thereof; and a speech quality assessment module which performs speech quality assessment of the speech signal based on the detection of impulsive noise in the speech signal during active speech portions thereof by the impulse noise detector.

DETAILED DESCRIPTION OF THE PREFERRED EMBODIMENTS

Given a received speech signal which may, for example, have been transmitted across a Voice over Internet Protocol (VoIP) communications network, the speech signal as received may include impulsive noise which, in accordance with the principles of the present invention, may be advantageously detected therein. Illustratively, the "noisy speech"—namely, the speech signal with the impulsive noise included therein—may, for example, be mathematically modeled by an additive process wherein:

$$y(i)=s(i)+n(i),$$

where s(i) and n(i) denote the speech and the impulsive noise, respectively. Therefore, in accordance with certain illustrative embodiments of the present invention, impulsive noise may be advantageously detected (i.e., estimated) given an estimate of the speech signal (without the impulsive noise), by simply subtracting such an estimate of the ("clean") speech signal from the received speech signal.

Figure 1:
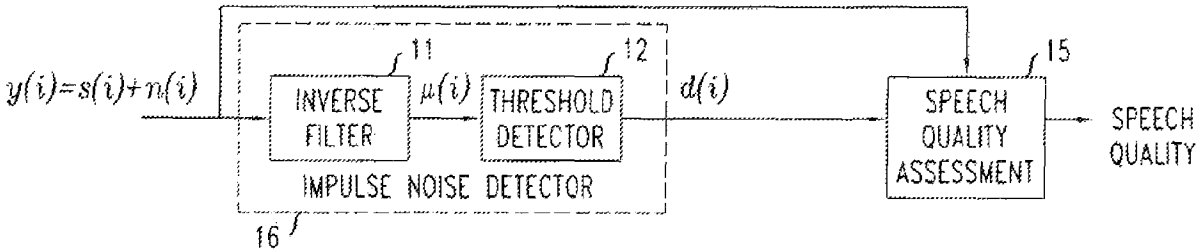
FIG. 1 shows a block diagram of an illustrative apparatus for performing a speech quality assessment of a received speech signal based on the detection and analysis of impulsive noise therein in accordance with an illustrative embodiment of the present invention.

FIG. 1 shows a block diagram of an illustrative apparatus for performing a speech quality assessment of a received speech signal based on the detection and analysis of impulsive noise therein in accordance with an illustrative embodiment of the present invention. As shown in the figure, the received speech signal, y(i), illustratively comprises a summation of the speech signal without the impulsive noise, s(i), and the impulsive noise itself, n(i). In accordance with the illustrative embodiment shown in the figure, impulse noise detector 16 advantageously detects the presence of impulsive noise in the received speech signal. Specifically, as shown in the figure, short-term inverse filter 11 is first applied to the received speech signal to determine residual μ(i). (See the discussion of FIG. 5 below for an illustrative embodiment of inverse filter 11.)

Given the residual signal generated by inverse filter 11, threshold detector 12 compares the absolute value of this residual to a calculated threshold. If the calculated threshold is exceeded, the given location of the speech signal is advantageously considered to be corrupted by impulsive (or impulse-like) noise, which is indicated in the output of threshold detector 12, d(i). [Illustratively, output d(i) may, for example, comprise a sequence of binary values indicative of whether or not impulsive noise has or has not been detected at the given position, i, in the speech signal.] Impulse-like noise (which is advantageously not typically correlated with the speech signal) may be easily detected in the residual by, for example, a conventional adaptive thresholding technique. (See the discussion below for an illustrative embodiment of threshold detector 12.)

Next, speech quality assessment module 15 advantageously performs a (single-ended) speech quality assessment at least in part based on the detection of impulsive noise in the received speech signal by impulse noise detector 16. In accordance with certain illustrative embodiments of the present invention, speech quality assessment module 15 may, for example, advantageously calculate statistics based on the absolute value of the residual, μ(i), having exceeded the threshold, as indicated by d(i). Such statistics may, for example, include, among others, histograms of the duration between consecutive corruptions and/or histograms of sample locations within a frame (which may, for example, comprise 160 contiguous speech samples) where corruption occurred. (The method of calculating each of these statistics is well known to those of ordinary skill in the art.)

As a result of this statistical analysis, in accordance with such illustrative embodiments of the present invention, speech quality assessment module 15 advantageously generates a speech quality assessment of the received speech signal. Such speech quality assessment may, for example, comprise a Mean Opinion Score (MOS), which may, for example, be represented by a number from 1 (for the worst quality assessment) to 5 (for the best quality assessment). In accordance with various illustrative embodiments of the present invention, speech quality assessment module 15 may either assess speech quality degradation resulting from the presence of impulsive noise only, or may assess speech quality degradation resulting from the presence of impulsive noise as well as other noise, such as may be performed in accordance with ITU-T Recommendation P.563.

In accordance with other illustrative embodiments of the present invention, impulsive noise detector 16 of FIG. 1 may be replaced by other, alternative techniques for detecting impulsive noise. Such alternative techniques, which will be familiar to those skilled in the art, include, for example, a Baysian detector, iterative methods in which speech parameter estimates and impulsive noise location estimates are iterated until certain convergence criteria are met.

Figure 2:
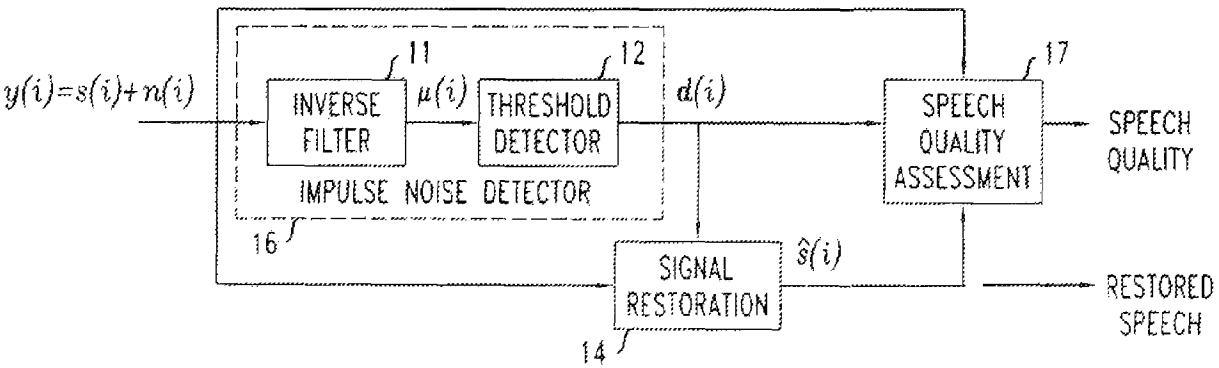
FIG. 2 shows a block diagram of an illustrative apparatus for performing a speech quality assessment of a received speech signal based on the detection and analysis of impulsive noise therein, in accordance with another illustrative embodiment of the present invention.

FIG. 2 shows a block diagram of an illustrative apparatus for performing a speech quality assessment of a received speech signal based on the detection and analysis of impulsive noise therein, in accordance with another illustrative embodiment of the present invention. In particular, the illustrative apparatus shown in this figure adds signal restoration module 14 to the illustrative apparatus shown in FIG. 1, and replaces speech quality assessment module 15 with a modified version thereof—(single-ended) speech quality assessment module 17. In particular, signal restoration module 14 of FIG. 2 advantageously reconstructs the corrupted sample (or series of corrupted samples), and thereby advantageously provides for the ability of the illustrative embodiment of FIG. 2 to gain further insight into the statistics of the corruption—in particular, enabling, for example, impulse-noise statistics, statistics of affected speech samples, estimates of noise pulse samples, amplitude histograms of estimated additive impulse noise samples (absolute and/or normalized), and/or amplitude histograms of estimated samples that have been corrupted, etc., to be calculated and advantageously used by speech quality assessment module 17. Moreover, signal restoration module 14 of FIG. 2 also provides for the restoration of the corrupted signal portion in order to advantageously deliver a reconstructed speech signal to the user. (The reconstructed speech signal ŝ(i) is illustratively shown in the figure.) In accordance with various illustrative embodiments of the present invention, such signal restoration may be achieved, for example, using interpolation, extrapolation, and/or substitution techniques, each of which will be familiar to those of ordinary skill in the art.

In particular, in accordance with certain illustrative embodiments of the present invention, a conventional speech quality assessment technique (such as, for example, that of ITU-T Recommendation P.563) may also be advantageously performed on the reconstructed speech signal (rather than, as in prior art speech quality assessment systems, on the received speech signal itself), and the results thereof may then be advantageously combined with the results of speech quality assessment module 17 to produce an "overall" speech quality assessment which advantageously takes both impulsive noise and stationary (or near-stationary) noise into account. Alternatively, in accordance with one illustrative embodiment of the present invention, such a conventional speech quality assessment technique (such as, for example, that of ITU-T Recommendation P.563) may be incorporated into speech quality assessment module 17 so that the direct result thereof is such an "overall" speech quality assessment.

Figure 3:
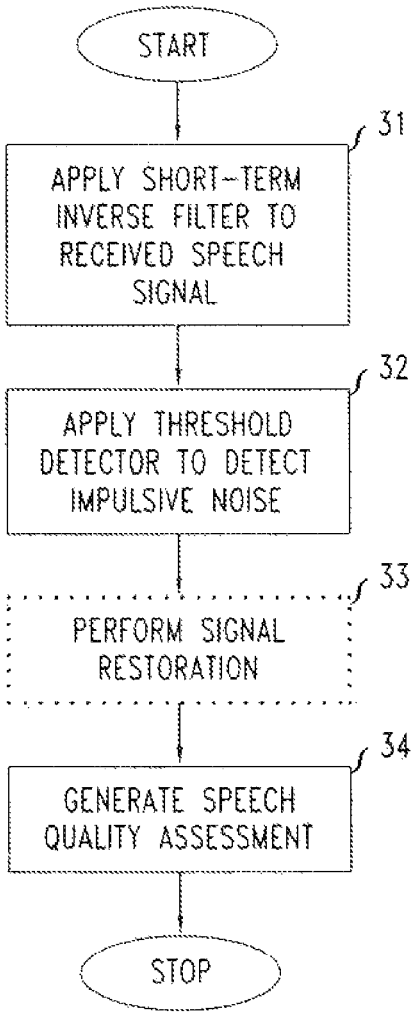
FIG. 3 shows a flowchart of an illustrative method for performing a speech quality assessment of a received speech signal based on the detection and analysis of impulsive noise therein in accordance with an illustrative embodiment of the present invention.

FIG. 3 shows a flowchart of an illustrative method for performing a speech quality assessment of a received speech signal based on the detection and analysis of impulsive noise therein in accordance with an illustrative embodiment of the present invention. The illustrative method, which may, for example, be advantageously performed by the illustrative apparatus shown in either FIG. 1 or FIG. 2, comprises applying a short-term inverse filter to the received speech signal (in block 31), and then applying a threshold detector to detect the presence of impulsive noise (in block 32). (Note that, blocks 31 and 32 in combination comprise applying an impulse noise detector. Also, see discussion below for illustrative details of an inverse filter and of a threshold detector.) Next, optionally (depending on whether the illustrative method of FIG. 3 is being performed by the illustrative apparatus shown in FIG. 1 or in FIG. 2), signal restoration is performed (see discussion above in connection with FIG. 2) on the received speech signal based on the detected impulsive noise (in block 33). Finally, a speech quality assessment is generated based on the detected impulsive noise from block 32 and optionally, on the signal restoration performed on the received speech signal by block 33 (in block 34).

Figure 4:
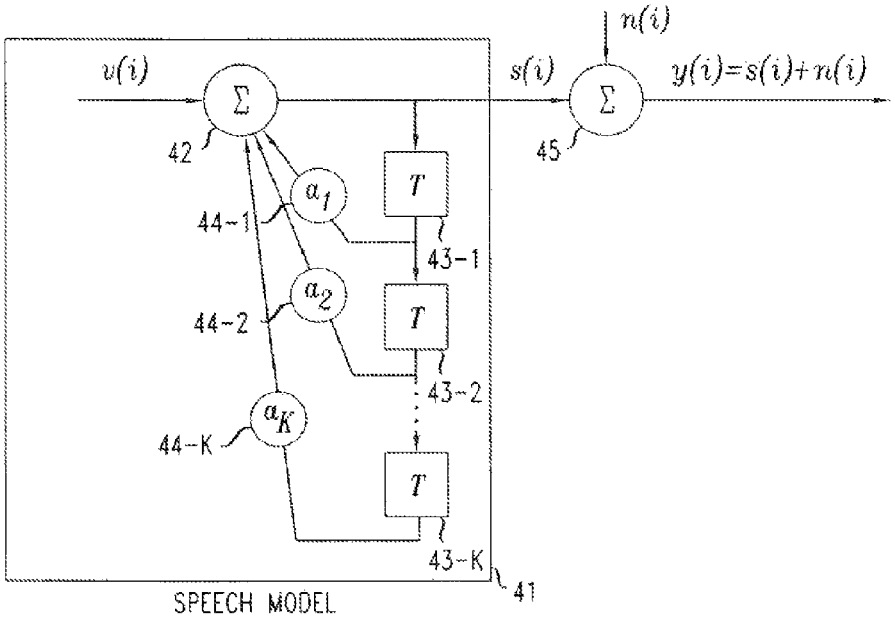
FIG. 4 shows a block diagram of an illustrative model for the generation of speech with impulsive noise, which may be advantageously employed in accordance with an illustrative embodiment of the present invention.

FIG. 4 shows a block diagram of an illustrative model for the generation of speech with impulsive noise, which may be advantageously employed in accordance with an illustrative embodiment of the present invention. First, note that one can advantageously model a speech signal, s(i), as an autoregressive (AR) model of order K (illustratively, K=10, given, for example, a speech signal sampling rate of 8 Kilohertz) given by the following equation:

$$s(i) = \sum_{j=1}^{K} a_j s(i-j) + \upsilon(i),$$

where $a_j$ denote the AR speech parameters and υ(i) denotes the speech excitation signal. (Note that the representation of a speech signal using an autoregressive model based on a speech excitation signal and a set of AR speech parameters is conventional and fully familiar to those of ordinary skill in the art. In particular, the AR speech parameters are typically considered to be representative of the human vocal tract.) Then, as pointed out above, the "noisy" speech signal, y(i) (which represents the "clean" speech signal with the impulsive noise included therein) may be advantageously modeled, for example, by an additive process wherein:

$$y(i)=s(i)+n(i).$$

Thus, the illustrative model shown in FIG. 4 comprises speech model 41 and adder 45. Speech model 41, in accordance with the illustrative AR model described above, comprises adder 42, unit time delays (T) 43-1 through 43-K, and AR speech parameters ($a_1 \ldots a_K$) 44-1 through 44-K. Specifically, to generate the speech signal, a speech excitation signal ν(i) is applied to adder 42, and as a result of the autoregressive model implemented by unit time delays 43-1 through 43-K and AR parameters 44-1 through 44-K, the ("clean") speech signal s(i) is produced therefrom. Finally, adder 45 adds the impulsive noise n(i) to the "clean" speech signal to produce the "noisy" signal y(i) (i.e., the speech with impulsive noise included therein).

Alternatively (although not shown in the figure), the "noisy" speech signal may be modeled by assuming that a noise signal replaces (rather than is added to) the speech signal during one or more sample intervals: (in other words, adder 45 of FIG. 4 may be replaced with a device that selects one of its inputs—s(i) or n(i)—based on the value of i.) For example, if a noise signal replaces the speech signal during a consecutive set of L samples (beginning with the sample following sample number M), the resultant speech signal may then instead be modeled as:

$$y(i) = \begin{cases} n(i); & \text{if } M < i < M + L \\ s(i); & \text{else.} \end{cases}$$

Figure 5:
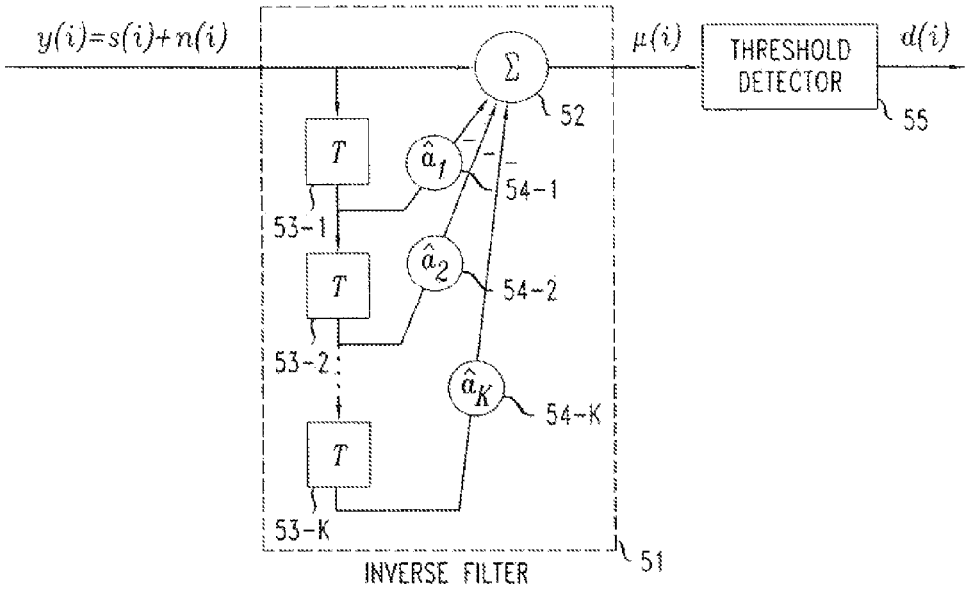
FIG. 5 shows a block diagram of an illustrative inverse filter and threshold detector for use in the illustrative apparatus of either FIG. 1 or FIG. 2 in accordance with certain illustrative embodiments of the present invention.

FIG. 5 shows a block diagram of an illustrative inverse filter and threshold detector for use in the illustrative apparatus of either FIG. 1 or FIG. 2 in accordance with certain illustrative embodiments of the present invention. Specifically, in accordance with these illustrative embodiments of the present invention, an autoregressive model, such as the one described above and shown in FIG. 4, may advantageously be used to estimate AR speech parameters from the received (i.e., "noisy") speech signal y(i), thereby generating a set of AR speech parameter estimates ($\hat{a}_1 \ldots \hat{a}_K$) for use in an inverse filter. (The generation of such AR speech parameter estimates is fully conventional and will be obvious to those of ordinary skill in the art.) Then this inverse filter, which is based upon these AR speech parameter estimates, may be advantageously employed to filter the noisy speech signal y(i) to generate a residual signal, μ(i), which itself comprises an estimate of the original speech excitation signal, υ(i), as used in the speech generation model (see FIG. 4 and the discussion thereof above).

However, regardless of which of the above (or other) noise models is used, when the speech signal s(i) has been corrupted by impulsive noise n(i), the resultant signal y(i) can no longer be correctly predicted based on the AR speech parameters of speech at the location of the impulsive noise. As such, the prediction error increases, which in turn, may be advantageously used in accordance with the principles of the present invention to detect the presence of impulsive noise in accordance with various illustrative embodiments thereof. That is, using the received speech signal y(i) and the AR speech parameter estimates $\hat{a}_j$, the residual signal (which represents the "noisy" excitation signal) may be advantageously expressed as:

$$\mu(i) = y(i) - \sum_{j=1}^{K} \hat{a}_j y(i-j).$$

Note that the total transfer function of the speech model and the inverse filter is given by the following z-transform:

$$H(z) = \frac{1 - \sum_{j=1}^{K} \hat{a}_j z^{-j}}{1 - \sum_{j=1}^{K} a_j z^{-j}}$$

From this equation therefore, it is apparent that the cascade of vocal tract and inverse filter advantageously becomes H(z)=1 for an accurate parameter estimate $\hat{a}_j$ (i.e., where all $\hat{a}_j = \hat{a}_j$). As a result, the output of the inverse filter would advantageously provide the actual excitation υ(i) of the original speech in the absence of noise (i.e., if n(i)=0). If, on the other hand, noise is present (i.e., if n(i)≠0), the output of the inverse filter provides the excitation υ(i) superimposed with the filtered noise (i.e., filtered with the inverse filter of speech). Thus, in accordance with the principles of the present invention and in accordance with certain illustrative embodiments thereof, the resultant "noisy" excitation signal μ(i) may be advantageously used to detect the presence of impulsive noise.

Specifically, then, in accordance with the illustrative embodiment of the present invention as shown, for example, in FIG. 5, estimates for the AR speech parameters (denoted by $\hat{a}_j$) are first advantageously obtained from the noisy speech signal y(i). Inverse filter 51 of the estimated speech model (i.e., an order K autoregressive model based on the estimated AR speech parameters $\hat{a}_j$) is then advantageously applied to the noisy speech signal y(i). Specifically, inverse filter 51 comprises adder 52, unit time delays (T) 53-1 through 53-K, and AR speech parameter estimates ($\hat{a}_1 \ldots \hat{a}_K$) 54-1 through 54-K. Threshold detector 55 is then advantageously applied to residual signal μ(i) (i.e., the inverse filtered signal) to detect the presence of impulsive noise—indicated in the figure as d(i).

In particular, first note that the ratio of a typical speech excitation signal to its standard deviation (i.e., the square root of its variance) is, in practice, limited. That is, given a speech excitation signal υ(i) and its variance $\delta_\upsilon^2(i)$, a constraint may be advantageously derived from the ratio:

$$r(i) = \frac{|\upsilon(i)|}{\delta_\upsilon(i)},$$

wherein, the value of r(i) may be reasonably constrained to be less than or equal to a predetermined maximum value (such as, for example, 3). Since, in accordance with the illustrative embodiment of the present invention described herein, the actual speech excitation υ(i) is unavailable, threshold detector 55 advantageously makes use of the residual signal μ(i) which is, in fact, an estimate of the excitation signal υ(i)—to calculate such a ratio.

Specifically; in accordance with one illustrative embodiment of the present invention, a threshold is advantageously calculated at each sample using the following equation:

$$\text{thresh}(i) = \kappa \cdot \delta_\mu(i)$$

where κ is a constant (illustratively, κ=3), and where $\delta_\mu^2(i)$ is the short-term variance of residual signal μ(i). Then, the output of threshold detector 55 may be advantageously defined as:

$$d(i) = \begin{cases} 1, & \text{if } |\mu(i)| > \text{thresh}(i) \text{ (noise pulse)} \\ 0, & \text{else (no noise pulse)} \end{cases}$$

In other words, the absolute value of μ(i) is compared with thresh(i). Note that the choice of a value for the constant κ effectuates a trade-off between false detection of noise pulses (i.e., the detection of noise pulses where none are actually present) and missed detection of noise pulses (i.e., the failure to detect the presence of noise pulses when they are present). That is, increasing the value of κ will reduce false noise pulse detection errors, but increase missed noise pulse detection errors, while decreasing the value of κ will increase false noise pulse detection errors, but reduce missed noise pulse detection errors.

Once noise pulses have been detected, in accordance with certain illustrative embodiments of the present invention, speech quality degradation due to impulsive noise may be advantageously assessed based on, for example, the number of detected noise pulses per given time interval (illustratively, using a time interval of 8 seconds) and/or based on, for example, the average normalized noise pulse magnitude (which may, for example, be advantageously normalized to the short-term speech level). And in accordance with certain illustrative embodiments of the present invention, impulsive noise may be advantageously removed (see, for example, the illustrative embodiment shown in FIG. 2 and discussed above), and other (conventional) speech quality prediction measures (such as, for example, the technique of ITU-T Recommendation P.563) may then be advantageously performed.

Figure 6:
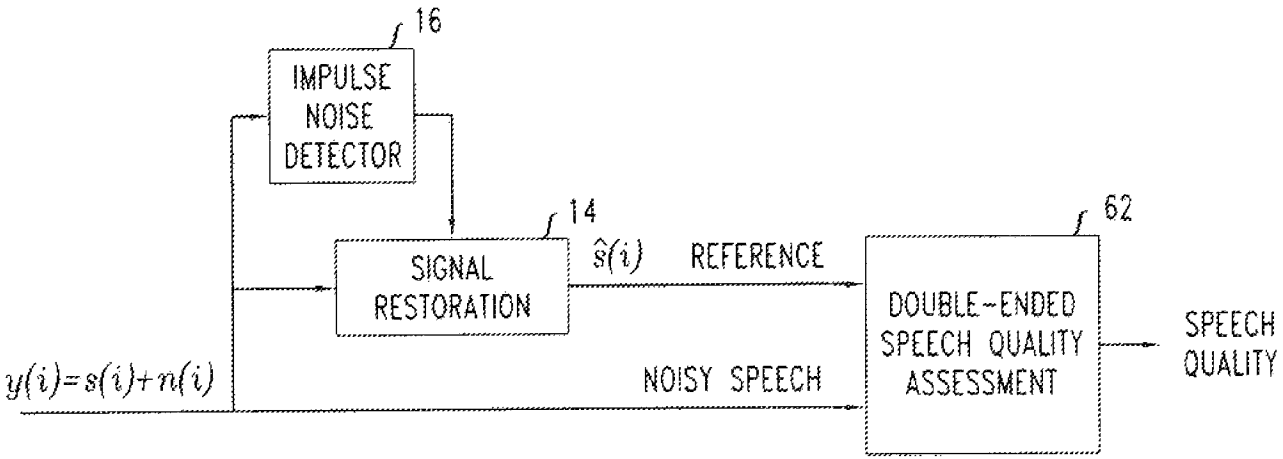
FIG. 6 shows a block diagram of an illustrative apparatus for performing a speech quality assessment of a received speech signal based on the detection and analysis of impulsive noise therein, in accordance with yet another illustrative embodiment of the present invention.

FIG. 6 shows a block diagram of an illustrative apparatus for performing a speech quality assessment of a received speech signal based on the detection and analysis of impulsive noise therein, in accordance with yet another illustrative embodiment of the present invention. In particular, the illustrative embodiment of the present invention shown in FIG. 6 makes advantageous use of a restored speech signal (see discussion of FIG. 2 above) to perform double-ended speech quality assessment, as opposed to the single-ended speech quality assessment performed by the illustrative embodiments shown in FIGS. 1 and 2.

In particular, in accordance with the illustrative embodiment shown in FIG. 6, both impulse noise detector 16 and signal restoration module 14 are the same as those shown in FIG. 2. (Impulse noise detector 16 may, for example, comprise inverse filter 11 and threshold detector 12, or may make use of an alternate technique as described above in connection with FIG. 1.) However, in accordance with the illustrative embodiment of the present invention shown in FIG. 6, double-ended speech quality assessment module 62 advantageously performs a double-ended speech quality assessment in which the noisy speech (i.e., the received speech) quality is assessed using the restored signal, $\hat{s}(i)$, as a reference signal for comparison purposes. Illustratively, speech quality assessment module 62 may be implemented using conventional techniques such as, for example, the technique of ITU-T Recommendation P.862.

In accordance with certain illustrative embodiments of the present invention, the speech quality assessment may be advantageously performed using a psychoacoustic perceptual hearing model. As is fully familiar to those of ordinary skill in the art, a psychoacoustic perceptual hearing model considers well known masking properties of the human ear to assess the degree to which speech will mask the presence of noise and the degree to which noise will mask the presence of speech. These models are conventional and are fully familiar to those of ordinary skill in the art.

And finally, note that in accordance with certain illustrative embodiments of the present invention, the techniques of the present invention may be employed not only for performing quality assessment purposes, but also for the detection of faulty equipment. A statistical analysis provided in accordance with such an illustrative embodiment may be used to advantageously shorten the search for the root-cause of such an impairment, be it faulty hardware or software.

Addendum to the Detailed Description

The preceding merely illustrates the principles of the invention. It will thus be appreciated that those skilled in the art will be able to devise various arrangements which, although not explicitly described or shown herein, embody the principles of the invention and are included within its spirit and scope. Furthermore, all examples and conditional language recited herein are principally intended expressly to be only for pedagogical purposes to aid the reader in understanding the principles of the invention and the concepts contributed by the inventor(s) to furthering the art, and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

Thus, for example, it will be appreciated by those skilled in the art that the block diagrams herein represent conceptual views of illustrative circuitry embodying the principles of the invention. Similarly, it will be appreciated that any flow charts, flow diagrams, state transition diagrams, pseudocode, and the like represent various processes which may be substantially represented in computer readable medium and so executed by a computer or processor, whether or not such computer or processor is explicitly shown.

A person of ordinary skill in the art would readily recognize that steps of various above-described methods can be performed by programmed computers. Herein, some embodiments are also intended to cover program storage devices, e.g. digital data storage media, which are machine or computer readable and encode machine-executable or computer-executable programs of instructions, wherein said instructions perform some or all of the steps of said above-described methods. The program storage devices may be, e.g., digital memories, magnetic storage media such as magnetic disks and magnetic tapes, hard drives, or optically readable digital data storage media. The embodiments are also intended to cover computers programmed to perform said steps of the above-described methods.

The functions of any elements shown in the figures, including functional blocks labeled as "processors" may be provided through the use of dedicated hardware as well as hardware capable of executing software in association with appropriate software. When provided by a processor, the functions may be provided by a single dedicated processor, by a single shared processor, or by a plurality of individual processors, some of which may be shared. Moreover, explicit use of the term "processor" or "controller" should not be construed to refer exclusively to hardware capable of executing software, and may implicitly include, without limitation, digital signal processor (DSP) hardware, read only memory (ROM) for storing software, random access memory (RAM), and non volatile storage. Other hardware, conventional and/or custom, may also be included. Similarly, any switches shown in the figures are conceptual only. Their function may be carried out through the operation of program logic, through dedicated logic, through the interaction of program control and dedicated logic, or even manually, the particular technique being selectable by the implementer as more specifically understood from the context.

In the claims hereof any element expressed as a means for performing a specified function is intended to encompass any way of performing that function including, for example, a) a combination of circuit elements which performs that function or b) software in any form, including, therefore, firmware, microcode or the like, combined with appropriate circuitry for executing that software to perform the function. The invention as defined by such claims resides in the fact that the functionalities provided by the various recited means are combined and brought together in the manner which the claims call for. Applicant thus regards any means which can provide those functionalities as equivalent as those shown herein.

What is claimed is:

1. A method for performing speech quality assessment of a speech signal, the speech signal received from a speech communications network, the method comprising:

receiving a speech signal from the speech communications network;

applying an impulse noise detector to the speech signal to detect impulsive noise contained in the speech signal during active speech portions thereof; and performing speech quality assessment of the speech signal based on the detection of impulsive noise in the speech signal during active speech portions thereof by the impulse noise detector;

wherein the step of applying the impulse noise detector to the speech signal comprises:

applying an inverse filter to the speech signal to generate a residual signal thereof, the inverse filter having been derived based on an autoregressive model of the speech signal; and applying a threshold detector to the residual signal to identify the presence of impulsive noise in the speech signal, wherein the presence of impulsive noise is identified based on the residual signal and on a statistical variance thereof.

2. The method of claim 1 further comprising the step of performing signal restoration based on the identified presence of impulsive noise to generate a modified speech signal having said identified impulsive noise removed therefrom, and wherein the speech quality assessment of the speech signal is performed further based on an analysis of the modified speech signal.

3. The method of claim 2 wherein the speech quality assessment comprises a single-ended speech quality assessment.

4. The method of claim 3 wherein the analysis of the modified speech signal is performed in accordance with ITU-T Recommendation P.563.

5. The method of claim 2 wherein the speech quality assessment comprises a double-ended speech quality assessment and wherein the modified speech signal is used thereby as a reference signal.

6. The method of claim 1 where the autoregressive (AR) model of the speech signal is defined as $$s(i) = \sum_{j=1}^{K} a_j s(i-j),$$

where s(i) is the speech signal, K is a constant, and $a_j$, for j=1 through K, are a set of AR parameters, and wherein the inverse filter is effectuated by performing the function $$\mu(i) = y(i) - \sum_{j=1}^{K} \hat{a}_j y(i-j),$$

where μ(i) is the residual signal, y(i) is the speech signal, K is a constant, and $\hat{a}_j$, for j=1 through K, are a set of AR parameter estimates derived from the speech signal.

7. The method of claim 1 wherein the presence of impulsive noise is identified by the threshold detector if a ratio of the residual signal to a standard deviation thereof exceeds a predetermined threshold.

8. The method of claim 1 wherein performing the speech quality assessment comprises performing a statistical analysis of one or more identifications of the presence of impulsive noise in the speech signal.

9. The method of claim 8 wherein the speech quality assessment is based on a number of times the presence of impulsive noise in the speech signal is identified in a given time interval.

10. The method of claim 8 wherein the speech quality assessment is based on a computation of an average normalized magnitude of said one or more identifications of the presence of impulsive noise in the speech signal.

11. The method of claim 8 wherein the speech quality assessment is based on a psychoacoustic perceptual hearing model.

12. The method of claim 1 wherein the speech quality assessment comprises a Mean Opinion Score.

13. An apparatus for performing speech quality assessment of a speech signal, the speech signal received from a speech communications network, the apparatus comprising:

a signal receiver which receives a speech signal from the speech communications network;

an impulse noise detector applied to the speech signal to detect impulsive noise contained in the speech signal during active speech portions thereof; and a speech quality assessment module which performs speech quality assessment of the speech signal based on the detection of impulsive noise in the speech signal during active speech portions thereof by the impulse noise detector;

wherein the step of applying an impulse noise detector to the speech signal comprises:

applying an inverse filter to the speech signal to generate a residual signal thereof, the inverse filter having been derived based on an autoregressive model of the speech signal; and applying a threshold detector to the residual signal to identify the presence of impulsive noise in the speech signal, wherein the presence of impulsive noise is identified based on the residual signal and on a statistical variance thereof.

14. The apparatus of claim 13 further comprising a signal restoration model which performs signal restoration based on the identified presence of impulsive noise to generate a modified speech signal having said identified impulsive noise removed therefrom, and wherein the speech quality assessment module performs the speech quality assessment of the speech signal further based on an analysis of the modified speech signal.

15. The apparatus of claim 14 wherein the speech quality assessment module performs a single-ended speech quality assessment.

16. The apparatus of claim 15 wherein the analysis of the modified speech signal is performed in accordance with ITU-T Recommendation P.563.

17. The apparatus of claim 14 wherein the speech quality assessment module performs a double-ended speech quality assessment and wherein the modified speech signal is used thereby as a reference signal.

18. The apparatus of claim 13 where the autoregressive (AR) model of the speech signal is defined as $$s(i) = \sum_{j=1}^{K} a_j s(i-j),$$

where s(i) is the speech signal, K is a constant, and $a_j$, for j=1 through K, are a set of AR parameters, and wherein the inverse filter is effectuated by performing the function $$\mu(i) = y(i) - \sum_{j=1}^{K} \hat{a}_j y(i-j),$$

where μ(i) is the residual signal, y(i) is the speech signal, K is a constant, and $\hat{a}_j$, for j=1 through K, are a set of AR parameter estimates derived from the speech signal.

19. The apparatus of claim 13 wherein the presence of impulsive noise is identified by the threshold detector if a ratio of the residual signal to a standard deviation thereof exceeds a predetermined threshold.

20. The apparatus of claim 13 wherein the speech quality assessment module performs a statistical analysis of one or more identifications of the presence of impulsive noise in the speech signal.

21. The apparatus of claim 20 wherein the speech quality assessment is based on a number of times the presence of impulsive noise in the speech signal is identified in a given time interval.

22. The apparatus of claim 20 wherein the speech quality assessment is based on a computation of an average normalized magnitude of said one or more identifications of the presence of impulsive noise in the speech signal.

23. The apparatus of claim 20 wherein the speech quality assessment is based on a psychoacoustic perceptual hearing model.

24. The apparatus of claim 13 wherein the speech quality assessment comprises a Mean Opinion Score.

* * * * *